United States Patent [19]

Belcher et al.

[11] 4,166,267

[45] Aug. 28, 1979

[54] ELECTRIC FUSE HAVING HEAT RETAINING MEANS

[75] Inventors: Richard A. Belcher, Hampton Falls; Frederick J. Kozacka, South Hampton, both of N.H.

[73] Assignee: Gould Inc., Rolling Meadows, Ill.

[21] Appl. No.: 872,750

[22] Filed: Jan. 27, 1978

[51] Int. Cl.[2] ..... H01H 85/04

[52] U.S. Cl. ..... 337/163; 337/166; 337/295

[58] Field of Search ..... 337/163, 164, 165, 166, 337/167, 158, 159, 160, 161, 162, 290, 291, 292, 293, 294, 295, 296, 251, 252, 253, 276

[56] References Cited

U.S. PATENT DOCUMENTS

| | | | |
|---|---|---|---|
| 1,968,763 | 7/1934 | Hanson et al. | 337/252 |
| 3,143,615 | 8/1964 | Kozacka | 337/163 |
| 3,261,952 | 7/1966 | Kozacka | 337/163 |
| 3,291,943 | 12/1966 | Kozacka | 337/163 |
| 3,319,028 | 5/1967 | Kozacka | 337/276 |
| 3,935,553 | 1/1976 | Kozacka et al. | 337/160 |

*Primary Examiner*—Harold Broome
*Attorney, Agent, or Firm*—Erwin Salzer

[57] ABSTRACT

A time-lag fuse of the type including a fusible element proper, and heat dams formed by strips of sheet metal folded in a direction transversely to the direction of the fusible element proper impeding the axially outer heat flow from said fusible element proper. The fusible element proper has several straight edges extending parallel to the axis of the casing of the fuse. Points of the heat dams engage the inner surface of the casing of the fuse and thus ensure correct positioning of the fusible element proper, i.e. in such a way that its edges extend always parallel to, and are equidistantly spaced from, the axis of the casing. The heat dams engage the inner surface of the casing at discrete points only, to minimize the area of engagement between said heat dams and the inner surface of the casing and to thus minimize direct heat flow from one to the other.

9 Claims, 5 Drawing Figures

ELECTRIC FUSE HAVING HEAT RETAINING MEANS

BACKGROUND OF THE INVENTION

This invention relates to time-lag fuses, and more particularly to time-lag fuses whose fusible element has a low fusing point overlay, e.g. an overlay of tin, which forms alloys with the base metal of which the fusible element is made, e.g. copper or silver. A low-fusing point overlay means in this context that the fusing point of the overlay metal is lower than the fusing point of the base metal, and thus reduces by well-known diffusion processes the melting point of the resulting alloy of overlay metal and base metal, i.e. the melting point of the fusible element.

The low-fusing point alloys formed by the overlay metal and the base metal of the fusible element have a derating effect on the fuse, and this derating effect is the first reason for the time-lag achieved by low fusing point overlays. Another reason lies in the fact that alloys formed by the overlay metal and the base metal such as, e.g. tin and copper, have a higher specific resistance than either of their components. Thus the aforementioned alloy-formation results in a severance of the current path through the fuse at lower temperatures and lower current intensities that would occur in the presence of a comparable mono-metallic fusible element.

Electric fuses having low melting temperature overlays that cause severing of the fusible elements have been known for many years, and subject to continuous improvements, and the present invention is concerned with one such improvement. In particular the present invention is concerned with an improvement of fuses of the kind disclosed in U.S. Pat. No. 3,291,943 to Frederick J. Kozacka, 12/13/66, TIME-LAG FUSE WITH RIBBON FUSE LINK FOLDED IN LONGITUDINAL AND IN TRANSVERSE DIRECTION. The above patent is, in turn, a continuation-in-part of the co-pending patent applications of the aforementioned Frederick J. Kozacka, Ser. No. 414,630 and Ser. No. 414,750, both filed on 11/30/64, now U.S. Pat. No. 3,260,952, 07/19/66 and U.S. Pat. No. 3,261,950, 07/19/66.

The aforementioned U.S. Pat. No. 3,291,943 describes a fuse having a casing of insulating material, filled with a pulverulent arc-quenching filler and a pair of electroconductive terminal elements closing the ends of the casing. A fusible element or ribbon fuse link of a high fusing point metal, e.g. copper, inside said casing is surrounded by said arc-quenching filler and interconnects said pair of electroconductive terminal elements. Said fuse link includes an overlay of a low fusing point metal, e.g. tin. An axially, or fusible element proper, inner portion includes flanges enclosing acute angles with the planar web portion of the fusible element proper. The aforementioned flanges define serially related points of reduced cross-sectional area. Said fusible element further includes a pair of axially outer ends or connector tabs each conductively connected to one of the terminals of the fuse. Each fusible element further includes an intermediate portion between said connector tabs and said flanges. Each of these intermediate portions has a larger cross-sectional area than any of said points of reduced cross-sectional area of said pair of flanges. Each of said pair of intermediate portions is bent at a first point to form a first loop directed toward the center of said pair of flanges. Each of said pair of intermediate portions is further bent at a second point spaced from said first point to form a second loop directed away from the center of said pair of flanges and toward one of said pair of electroconductive terminal elements.

The aforementioned intermediate portions in the above design fulfill a number of functions. They compensate for the elongations and contractions which result from the various amounts of current carried by the fusible element proper, i.e. the above flanges supporting the overlay metal. The aforementioned intermediate portions serve further as heat dams reducing the axially outflow of heat from the fusible element proper to the pair of terminal elements at the outer ends of the casing.

As the pictorial representations of the structure of U.S. Pat. No. 3,291,943 suggest, its stability is relatively low. Slight unavoidable changes in the geometry of the above referred-to intermediate flanges may change the relative orientation of the fusible element proper and that of the casing, thus affecting the desired paralellism of the longitudinal edges of the fusible element proper and that of the axis of casing or, in other words, the constancy of the relative position of the fusible element proper to that of the axis of the casing, and consequently the uniformity of the radial heat flow in a number of speciments.

Fuses according to U.S. Pat. Nos. 3,261,950 and 3,261,952 are subject to the same limitations or drawbacks.

SUMMARY OF THE INVENTION

Fuses according to the present invention comprise a tubular casing of electric insulating material and electroconductive terminal elements affixed to and closing the ends of the casing. Said casing is filled with a pulverulent arc-quenching filler. The aforementioned terminal elements are interconnected by a fusible element proper its axial extensions forming heat dams and extensions of the of the latter forming connector tabs. The heat dams and connector tabs are formed by strips of sheet metal folded in a direction substantially transversely to the direction of the fusible element proper. The fusible element proper supports overlays for severing said element by a metallurgical reaction, i.e. a metal diffusion process. Said fusible element proper has a predetermined number of points of reduced cross-sectional area and has on both ends thereof the aforementioned integral substantially sinusoidally heat dams whose cross-section is less than the cross-section of the fusible element proper at the points of reduced cross-sectional area thereof. The purpose of these heat dams is to limit the outflow of heat generated in said fusible element proper in axial direction toward said electroconductive terminal elements. The heat dams are provided with connector tabs which are conductively connected to the terminal elements of the fuse.

The improvement according to the present invention comprises the fact that said heat dams are dimensioned in such a way that edges thereof engage the internal surface of said casing, whereas all of the points of the fusible element proper are equidistantly or fixedly spaced from the internal surface of the casing. Thus the heat dams serve the additional function of firmly positioning the fusible element proper inside of the casing of the fuse.

DESCRIPTION OF PREFERRED EMBODIMENT

Figure 1:
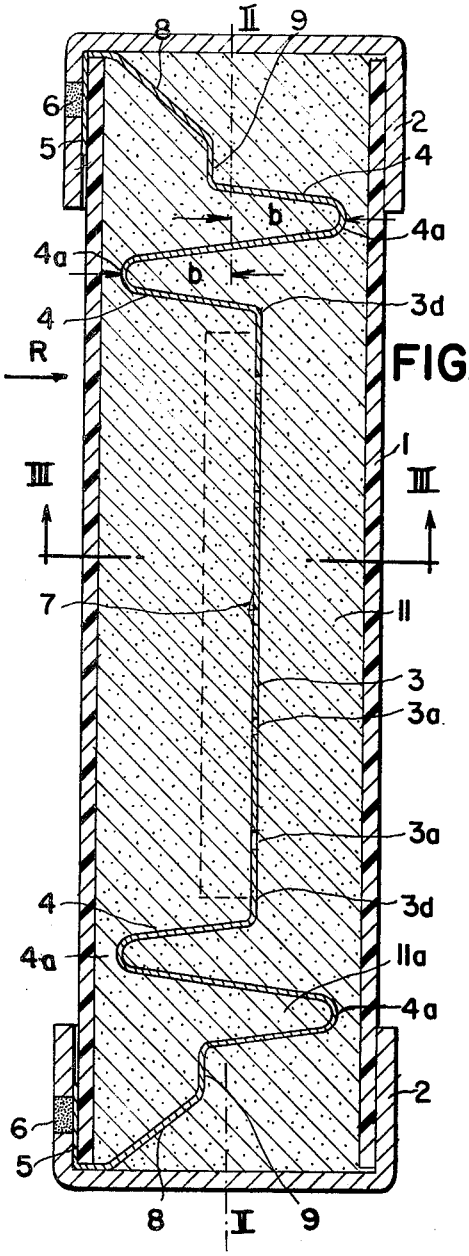
FIG. 1 is a longitudinal section of a preferred embodiment of the invention taken along I—I of FIG. 2.

Referring now to the drawing, numeral 1 has been applied to indicate a tubular casing of electric insulating material and numeral 2 has been applied to indicate a pair of electroconductive terminal elements affixed to and closing the ends of casing 1, e.g. caps or ferrules. Said terminal elements 2 are conductively interconnected by a fusible element 3 proper, its axial extensions forming heat dams 4 and extensions of the latter forming connector tabs 5. The current path through the fuse is thus as follows: upper connector tab conductively connected to upper terminal element 2, upper heat dam 4 integral with upper connector tab 5, fusible element 3 proper integral with upper heat dam 4, lower heat dam 4 integral with fusible element 3 proper, and lower connecter tab 5 integral with lower heat dam 4 and conductively connected to lower terminal element 2. Integral means in this context means that parts 5,4,3,4,5 are a unitary stamping of a piece of sheet metal, e.g. sheet copper or sheet silver. It will be evident from the above that parts 5,4,3,4,5 are connected in series when the fuse is inserted into an electric circuit. The conductive connection between terminal elements 2 and connector tabs 5 may be effected in a number of different ways well known in the art. As shown in the drawings, the connector tabs 5 are bent over the rims of casing 1 to engage the outer surface thereof, and the terminal elements, terminal caps or ferrules, are provided with a bore registering with connector tabs 5 and filled with soft solder 6 conductively interconnecting parts 2 and 5. The fusible element 3 proper supports an element-severing overlay 7 effecting severing of element 3 at the point of overlay 7 at a given temperature by a well known metallurgical reaction, which is a metal diffusion process governed by FICK'S DIFFUSION EQUATIONS. Fusible element 3 proper has perforations 3*a* which establish one or more points where the cross-sectional area of fusible element 3 proper or fuse link 3 is reduced. In the instant case five serially connected areas 3*b* of reduced cross-sectional area are provided in fusible element 3 proper. Fusible element 3 proper is substantially channel-shaped, including a web portion and two flange portions enclosing acute angles with the web portion. Overlay 7 extends across the outer surface of both flange portions and across that of the web portion.

Heat dams 4 whose configuration is substantially sinusoidal are arranged to both sides of fusible element 3 proper. The cross-section of heat dams 4 is less than the cross-section of fusible element 3 proper at the points of reduced cross-sectional area thereof to limit formation of breaks at major fault currents along either the axially outer or inner heat dams 4, i.e. to limit break formation to the fusible element 3 proper.

It will be observed that any point of fusible element 3 proper is spaced from the inner wall of casing 1. To be more specific, fusible element 3 proper is bounded by four longitudinal straight edges 3*c* which are parallel to the longitudinal axis of casing 1, and spaced from the inner surface thereof. This position is rigorously maintained by heat dams 4.

Figure 4:
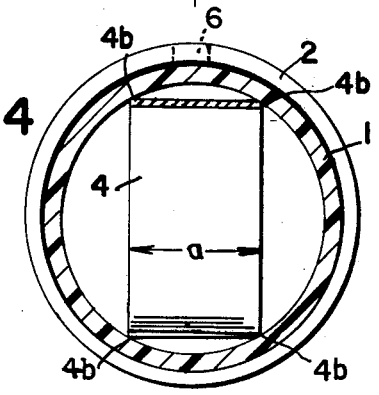
FIG. 4 is a transverse section along IV—IV of FIG. 2.
Figure 5:
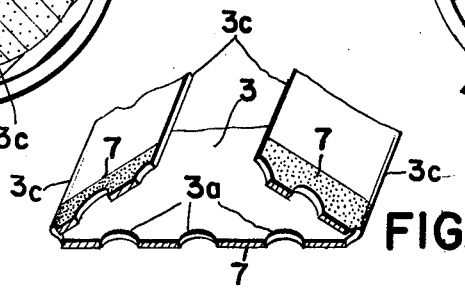
FIG. 5 shows the center portion of the fusible element proper and its element severing overlay in an isometric view.

Connector tabs 5 are connected to heat dams 4 by two sheet metal sections 8 and 9 of which the former is slanting and the latter parallel to the longitudinal axis of casing 1. Then follows the first loop 4*a* of heat dam 4. The width of said first loop 4*a* is equal to the width of the internal surface of casing 1 at the point where said first loop 4*a* is located so that the edges of the first loop 4*a* of heat dam 4 engage approximately punctiformly the inner surface of casing 1, i.e. the area of engagement of heat dams 4 is limited to discrete points only to limit the area of engagement of heat dam 4 and the inner surface of casing 1. This applies to all four heat dams 4 shown in the drawing and is best shown in FIG. 4. This figure shows in the upper portion thereof a cross-section of the axially inner loop 4*a* and in the lower portion a view of the axially outer loop 4*a* as well as the points 4*b* of physical engagement of said two loops 4*a*,4*a* with the inner surface of casing 1. This firmly positions the fusible element 3 proper, or the fusible element of stamping 5,8,9,4*a*,4*a*,3,4*a*,4*a*,9,8,5 relative to casing 1. In other words, the exact spacing of fusible element proper 3 with its edges 3*c* in parallel, spaced relation to the longitudinal axis of casing 1 is effected by the engagement of heat dams 4, and more specifically by the engagement of the loops 4*a*,4*a* with the points 4*b* thereof, with the inner surface of casing 1. This, in turn, assures the uniformity of heat flow away from the fusible element 3 proper of the fuse and consequently the uniformity of the rating of any number of specimens.

Figure 2:
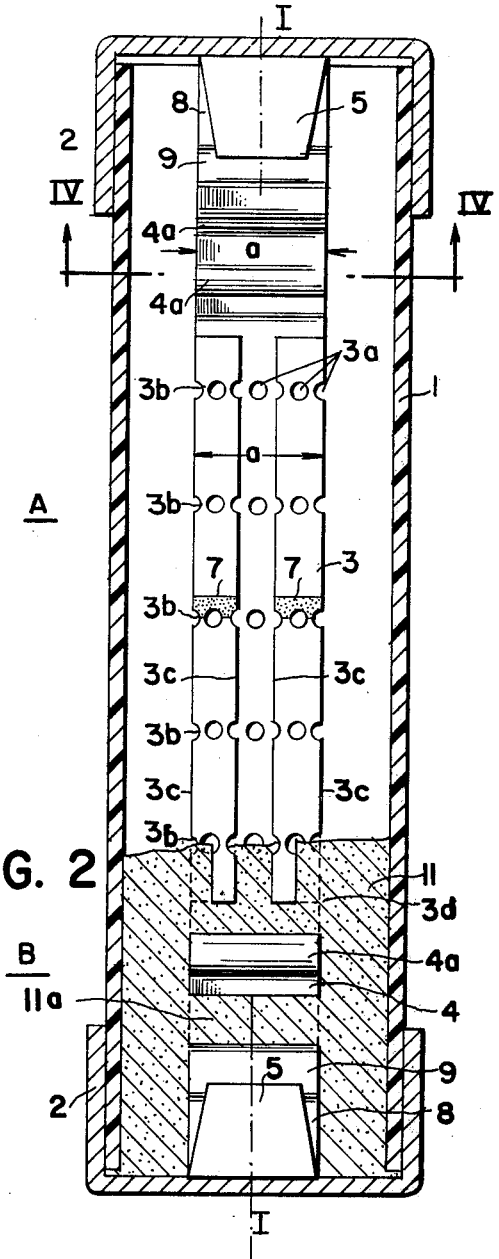
FIG. 2 is a longitudinal view of the structure of FIG. 1, the upper portion A of FIG. 2 showing the structure of FIG. 1 seen in the direction of arrow R of FIG. 1 in the absence of a pulverulent arc-quenching filler, and the lower portion B of FIG. 2 being a longitudinal section along 1—1 of FIG. 1.
Figure 3:
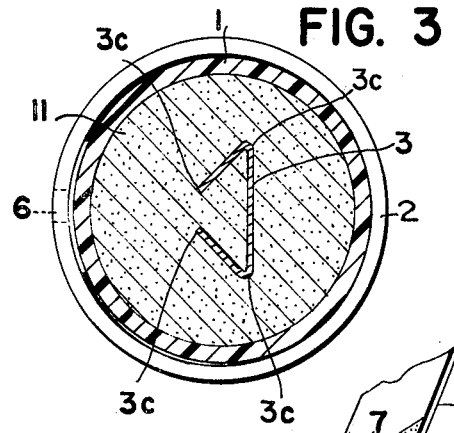
FIG. 3 is a transverse section along III—III of FIG. 1.

Casing 1 is filled with pulverulent, arc-quenching filler 11. The lower portions B of FIG. 2 show the portions of stamping 5,8,9,4*a*,4*a*,3 etc. situated in front of plane II—II of FIG. 1. Fusible element 3 proper ends at 3*d*. Reference numeral 4*a* has been applied to indicate in portion B of FIG. 2 the axially inner loop and a portion of the stamping 5,8,9,4*a* etc. situated between said axially inner loop 4*a* and the axially outer loop 4*a*. The axially outer loop 4*a* is situated behind plane II—II and thus FIG. 2 shows at this point the body of pulverulent filler 11*a* forming part of the larger body of pulverulent arc-quenching filler 11. The portions 9,8,5 of stamping 5,8,9,4*a* etc. arranged in front of plane II—II are fully shown in the lower portion B of FIG. 2.

It will be further noted that the stamping portions 9 interconnecting stamping portions 8 with heat dams 4 are oriented parallel to the axis of casing 1 and almost coincide with said axis, i.e. the spacings between portion 9 and said axis are so small that they can be neglected. Hence stamping portions 9 cannot transmit any significant torques to parts 4,3,4 tending to tilt said parts relative to housing 1.

FIGS. 2 and 4 show the width a of the web portion of fusible element 3 proper and the width a of the heat dam forming sinusoidally or zig-zag shaped sheet metal strips 4 to be equal, which simplifies stamping 5,8,9,4,3 etc. The amplitudes b of heat dam forming stampings 4 are of such height that the latter engages the inner surface of casing 1, but the area of such engagement is limited to four discrete points, thus minimizing direct heat flow from heat dams 4 to casing 1.

The width a of the portions of the stamping forming heat dams 4 is equal to the width of the web portion of fusible element proper 3, i.e. it is much less than the total width of the fusible element 3 proper.

It will also be apparent that each heat dam 4 is formed by a pair of loops. The amplitudes b of the loops determine the substantially punctiform engagement of the sheet metal loops 4*a* and of the casing 1. This has been clearly illustrated in FIGS. 1 and 4.

I claim as my invention:

1. An electric time-lag fuse comprising a tubular casing of electric insulating material, a pulverulent arc-quenching filler inside said casing, electro conductive terminal elements affixed to and closing the ends of said casing, and means conductively interconnecting said terminal elements wherein said means include a fusible element proper equidistantly spaced from said casing, having points of reduced cross-sectional area and a fusible-element-severing overlay, said means for conductively interconnecting said terminal elements further including heat dams formed of strips of sheet metal folded in a direction substantially transversely to the direction of said fusible element proper for limiting the flow of heat from said fusible element proper to said terminal elements, wherein the novel feature consists in that said heat dams engage the inner surface of said casing and thereby firmly position said fusible element proper equidistantly relative to said casing.

2. An electric time-lag fuse as specified in claim 1 wherein said heat dams engage the inner surface of said casing at discrete points only to limit the area of engagement of said heat dams and said inner surface of said casing.

3. An electric time-lag fuse as specified in claim 1 wherein said fusible element proper and said heat dams consist of sheet metal, the total width of said fusible element proper being in excess of the width of said heat dams, and the engagement of said heat dams with the inner surface of said casing being substantially punctiform to limit the area where heat flow can take place from said heat dams to said casing.

4. An electric time-lag fuse comprising a tubular casing of insulating material, electroconductive terminal elements affixed to and closing the ends of said casing and means conductively interconnecting said terminal elements wherein said means are formed by a metal stamping defining a fusible element proper spaced from said casing, having a plurality of straight edges, a plurality of serially related points of reduced cross-sectional area and a fusible-element-severing overlay of a metal having a lower fusing point than the base metal of said fusible element proper, said means further including heat dams on both ends of said fusible element proper for reducing the heat flow from said fusible element proper to said terminal elements, each of said heat dams being located at the axially outer ends of said fusible element proper and each including a pair of serially connected loops of sheet-metal, wherein the novel feature consists in that said loops of sheet-metal engage only at discrete points of the peak regions thereof the inner surface of said casing and thereby insure substantial parallelism of said straight edges of said fusible element proper and of the axis of said casing coupled with minimal direct heat flow from said loops of sheet metal to said casing.

5. An electric fuse as specified in claim 4 wherein said fusible element proper is substantially channel-shaped and includes two flange portions and a web portion having a predetermined width, and wherein each of said heat dam forming pair of loops is of the same width as said web portion and engages the inner surface of said casing substantially punctiform on account of the magnitude of the amplitudes of said pair of loops.

6. An electric fuse comprising a tubular casing of electric insulating material, a pulverulent arc-quenching filler inside said casing, a pair of electroconductive terminal elements affixed to and closing the ends of said casing, and means conductively interconnecting said pair of terminal elements, said means including a fusible element proper extending in a direction parallel to the longitudinal direction of said casing, and said fusible element proper having points of reduced cross-sectional area, an element-serving low fusing point overlay on said fusible element proper, said means for conductively interconnecting said pair of terminal elements further including a pair of substantially sinusoidally shaped strips of sheet metal folded in a direction substantially transversely to the longitudinal direction of said fusible element proper to form heat dams limiting the flow of heat from said fusible element proper to said terminal elements, wherein the novel feature consists in that said pair of strips engage the inner surface of said casing to maintain parallelism between said fusible element proper and said casing.

7. An electric fuse as specified in claim 6 wherein the area of engagement of said pair of strips and said inner surface of said casing is substantially punctiform to limit the flow of heat from said pair of strips to said casing.

8. An electric fuse comprising a tubular casing of electric insulating material, a pulverulent arc-quenching filler inside said casing, a pair of electroconductive terminal elements affixed to and closing the ends of said casing, and means conductively interconnecting said pair of terminal elements, said means for conductively interconnecting said pair of terminal elements including a fusible element proper extending in a direction parallel to the longitudinal axis of said casing and having points of reduced cross-sectional area, an element-severing low-fusing point overlay on said fusible element proper, and said means for conductively interconnecting said pair of terminal elements further including a pair of substantially zig-zag shaped loops of sheet metal interposed between said fusible element proper and said pair of terminal elements for the purpose of limiting the flow of heat from said fusible element proper to said pair of terminal elements, wherein the novel feature consists in that said loops are substantially at right angles to a planar portion of said fusible element proper and physically engage the inner surface of said casing at limited areas thereof to assure uniformity of heat flow away from said fusible element proper.

9. An electric fuse as specified in claim 8 wherein said means for interconnecting said pair of terminal elements include a pair of sections each located axially outwardly from one of said pair of loops and each approximately co-planar with said planar portion of said fusible element proper.

* * * * *